United States Patent [19]

Mazur

[11] 3,965,487

[45] June 29, 1976

[54] MULTI-USE INFANT GARMENT

[76] Inventor: Adella Mazur, 9 Holtham St., Hampstead H3X 3N2, Canada

[22] Filed: Dec. 13, 1974

[21] Appl. No.: 532,642

[52] U.S. Cl. ..... 2/69.5; 2/70; 2/80; 2/84

[51] Int. Cl.[2] ..... A41D 11/00; A41D 15/04

[58] Field of Search ..... 2/69.5, 70, 80, 69, 2/83, 84

[56] References Cited

UNITED STATES PATENTS

| | | | |
|---|---|---|---|
| 2,130,690 | 9/1938 | Lemoine | 2/70 |
| 2,142,479 | 1/1939 | Rosenfelder | 2/70 |
| 2,513,065 | 6/1958 | Stagg | 2/70 |
| 2,612,643 | 10/1952 | Perry | 2/70 |
| 2,738,512 | 3/1956 | Winer | 2/80 |
| 2,849,716 | 9/1958 | Kerson | 2/70 |

FOREIGN PATENTS OR APPLICATIONS

| | | | |
|---|---|---|---|
| 1,252,604 | 10/1967 | Germany | 2/69.5 |
| 1,188,180 | 3/1959 | France | 2/70 |

*Primary Examiner*—H. Hampton Hunter
*Attorney, Agent, or Firm*—Alan Swabey; Robert Mitchell

[57] ABSTRACT.

A multi-use infant garment comprising an upper garment having at least a chest section and a back section both of which define a lower edge. Fastening means is secured in a lower portion of the upper garment in the vicinity of the lower edge and extends substantially about the waist of the upper garment. A lower garment is also provided and is detachably secured to the upper garment by the fastening means.

1 Claim, 5 Drawing Figures

MULTI-USE INFANT GARMENT

BACKGROUND OF THE INVENTION

1. Field of the Invention

The present invention relates to a multi-use infant garment which is comprised of an upper garment capable of being secured and used with different lower garments.

2. Description of the Prior Art

Various types of convertible multi-purpose garments for children are known. It is also known to provide a garment for infants and adapted for use from birth to about two years old and wherein the lower portion of the garment may be formed into a bag like portion or leg portion. With certain types of one-piece garments, the lower leg portions are normally folded inside the lower portion whereby to constitute the bag portion. Thus, the bag portion is provided with sections of the garment extending inwardly within the bag. This is sometimes bothersome to the infant and it makes the bag-like section somewhat bulky. Further, this type bag-like section is often used to carry the infant's nursing bottle or other infant needs and it is therefore advantageous not to provide any further unnecessary pieces of garments within the bag-like portion.

Infants ranging from birth to approximately two years old outgrow various types of garments, between this two year life span, before wearing the garments out. Thus, such garments are discarded for the simple reason that they no longer fit the infant and it is therefore necessary to buy a new garment.

SUMMARY OF THE INVENTION

It is a feature of the present invention to provide a multi-use infant garment which substantially overcomes the above mentioned disadvantages.

It is a further feature of the present invention to provide a multi-use infant garment which comprises an upper garment capable of being secured or adapted to a lower garment which may consist of a bag-like garment, a pant garment or a leggings type garment.

According to the above features, from a broad aspect, the present invention provides a multi-use infant garment comprising an upper garment having at least a chest section and a back section both of which define a lower edge. Fastening means is secured in a lower portion of the upper garment in the vicinity of the lower edge and extends substantially about the waist of the upper garment. A lower garment is also provided and is detachably secured to the upper garment by the fastening means.

BRIEF DESCRIPTION OF THE DRAWINGS

A preferred embodiment of the present invention will now be described with reference to the accompanying drawings. It is of course understood that many obvious modifications may be made to the garment without departing from the scope of the invention as defined by the claims and by the foregoing paragraph.

In the drawings.

DESCRIPTION OF THE PREFERRED EMBODIMENTS

Figure 1A:
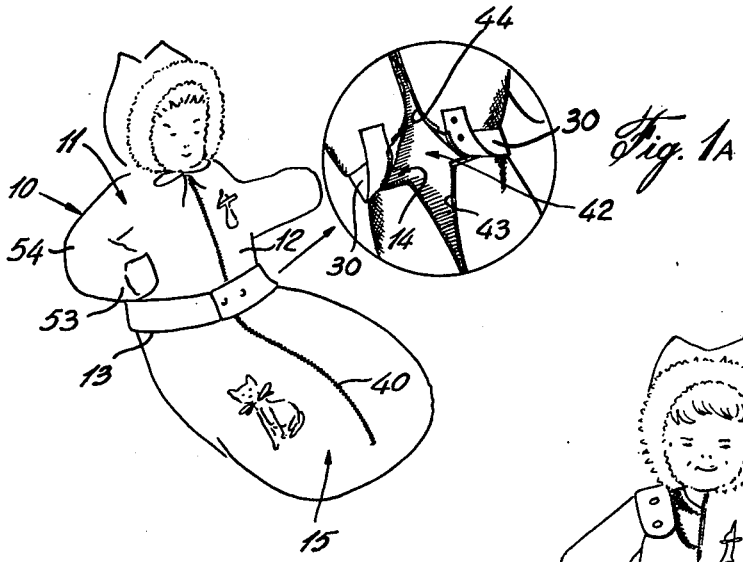
FIG. 1*a* to FIG. 1*d* are perspective illustrations of the multi-use infant garment illustrating its various uses.

Referring now to the drawings, there is shown generally at 10, the multi-use infant garment of the present invention. The garment 10 comprises an upper garment 11 having at least a chest section 12 and a back section (not shown). The upper garment 11 has a lower edge 13 and fastening means 14 (see FIG. 2) is secured in a lower portion of the inner surface of the upper garment 11 in the vicinity of the lower edge 13 and extends substantially about the waist of the upper garment 11. A lower garment 15 is detachably secured to the upper garment 11 by the fastening means 14, in a manner which will be described in detail later.

Figure 1B:
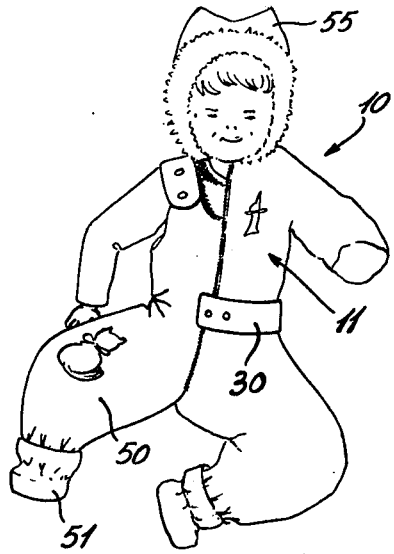
Figure 1C:
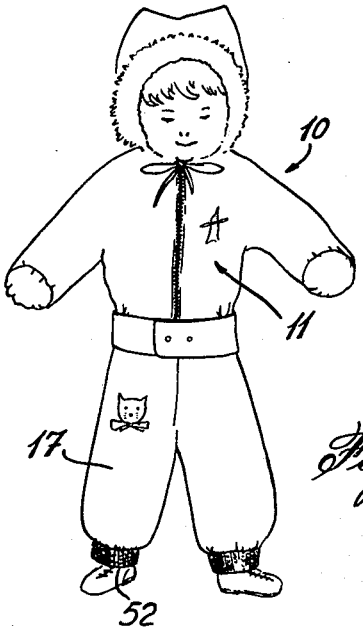
Figure 1D:
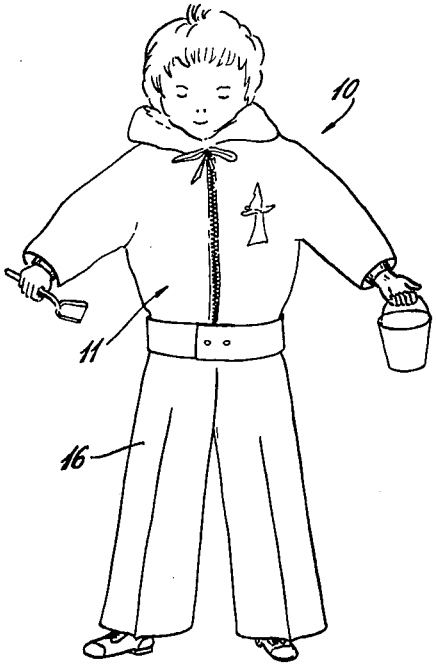

As shown in FIGS. 1*c* and 1*d* the lower garment 15 is herein constituted by a pant portion 16 or lower legging portions 17 which are also secured by the fastening means 14 or simply adapted to the upper garment 11.

Figure 2:
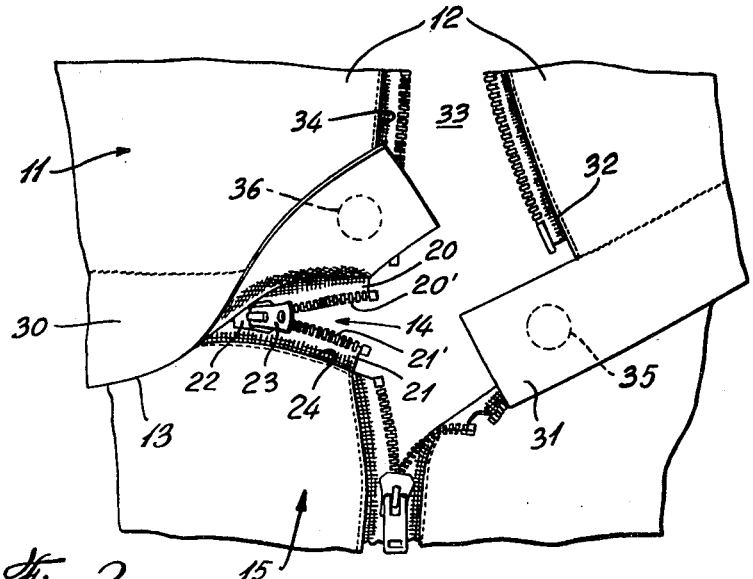
FIG. 2 is an enlarged, fragmented view of the manner in which the upper garment is secured to a lower garment.

Referring now to FIG. 2, there is shown the fastening means 14 as consisting of a slide fastener having two interlocking bands 20 and 21 each having interlocking elements 20' and 21' in the outer elongated edge of the bands. A slide housing 22 having a finger gripping element 23 secured thereto, causes engagement and disengagement of the interlocking elements 20' and 21' in a manner well-known in the art. The elongated band 20 is secured to the inner surface of the upper garment 11 in the vicinity of the lower edge 13 and the other band 21 is secured in an upper edge 24 of the lower garment 15.

As shown in FIG. 2, the band 20 is spaced inwardly from the lower edge 13 to define a marginal band portion 30 between the lower edge 13 and the fastening band 20. The marginal band 30 extends over and conceals the slide fastener 14. The marginal band portion 30 defines a belt portion 31 extending beyond a vertical edge 32 of a closeable vertical opening 33 extending from adjacent the lower edge 13 to a neck opening (not shown). The belt portion 31 overlaps the band portion 30 terminating at or beyond the opposed vertical edge 34 of the vertical opening 33. A female snap fastener 35 is provided on the inner surface of the belt portion 31 and interlocks with a further male snap fastener 36 provided on the outer surface of the band portion adjacent the opposite vertical edge 34.

As shown in FIGS. 1*a* and 2, the lower garment 15 is a bag-like garment. The bag-like garment 15 is also provided with a closeable opening 40 extending substantially transverse to the upper edge 24 and depending therefrom. The closeable opening 40 is herein shown provided in alignment with the closeable vertical opening 33 of the upper garment 11, both openings 40 and 33 being closeable by means of slide fasteners of the type as hereinbefore described relative to the fastening means 14. As shown in the blown-up section of FIG. 1*a* all of the slide fasteners have an end terminating substantially centrally on the front of the infant garment 10 as designated by numeral 42. The slide fastener 43 secures the opening 40 whilst the slide fastener 44 secures the opening 33. The slide fastener 14 secures the lower garment 15 to the upper garment 11. Thus, it can be seen that with this arrangement of fastening means, the garments can easily and quickly be detached from its sections or portions from a convenient central location in front of the infant wearing the garment.

The lower garment 16 and 17 as shown in FIGS. 1*c* and 1*d* are also provided with a slide fastener band adjacent an upper edge thereof to fasten the lower garment to the interlocking band 20 of the upper garment 11. Further, as shown in FIG. 1*b*, the upper garment 11 may be worn or adapted with other type apparel without utilizing the fastening means 14 which remains concealed. In FIG. 1*b* the upper garment 11 is shown in use over a leggings 50 comprising pants and an upper portion covering substantially all of the back and chest of the infant. In this particular use, the upper garment 11 is not secured to the lower garment. Also, booties 51 may be retained about the openings 52 normally provided in the lower end of the leggings by suitable fastening means such as snap fasteners (not shown). Still further, as shown in FIG. 1*a*, gloves or mittens 53 may also be secured about the end openings (not shown) of arm portions 54 normally provided with the upper garment. The mittens are also secured by suitable fastening means, such as snap fasteners.

The lower garments as above described illustrate the multi-use of the garment and other suitable types of lower garments may be provided without departing from the scope of the present invention. Also, the garment may be made out of a variety of suitable materials and various color combinations may be utilized for both the upper and lower garments whereby by alternating the various colored garment portions, the total appearance of the garment changes. Still further a hood 55 may be permanently or removably secured about the neck opening.

I claim:

1. A multi-use infant garment comprising an upper garment having at least a chest section and a back section, said upper garment defining a lower edge, a lower garment, said lower garment being detachably secured to said upper garment by a slide fastener consisting of two interlocking bands each having interlocking elements in an elongated edge thereof, a slide housing for causing engagement and disengagement of said interlocking elements in opposed bands, one of said bands being secured to said upper garment in the vicinity of said lower edge and the other of said bands being secured in an upper edge of said lower garment, said band secured to said inner surface of said upper garment being spaced inwardly from said lower edge to define a marginal band portion between said lower edge and said fastening means, said marginal band extending over and concealing said slide fastener, said upper garment having a closeable vertical opening extending from adjacent said lower edge to a neck opening, a second slide fastener for closing said vertical opening, said marginal band portion defining a belt portion extending beyond a vertical edge of said vertical opening whereby to overlap the band portion terminating at the opposed vertical edge of said vertical opening, and means to secure said overhanging belt portion to an outer surface portion of said band portion, said lower garment comprising a lower bag-like garment having an upper edge secured to said upper garment by said slide fastener, a closeable opening in said bag-like garment and extending substantially transverse to said upper edge and depending therefrom, said closeable opening being aligned with said closeable vertical opening of said upper portion and also closeable by a third slide fastener, all of said slide fasteners having an end terminating substantially centrally on the front of said infant garment whereby the garment sections can be detached from a central location in front of the garment where the slide housings meet, said upper garment being further provided with arm portions, said arm portions having a hand opening, at least one fastener secured adjacent said hand opening to retain a mitten about said hand opening, and a hood about a portion of a neck opening.

* * * * *